US005809739A

United States Patent [19]

Eno

[11] Patent Number: 5,809,739

[45] Date of Patent: Sep. 22, 1998

[54] FILLING MACHINE HAVING A SYSTEM TO AID IN CLEANING EXTERIOR SURFACES OF CARTONS FILLED THEREBY

[75] Inventor: Kenneth M. Eno, Burnsville, Minn.

[73] Assignee: Tetra Laval Holdings & Finance, SA, Pully, Switzerland

[21] Appl. No.: 826,025

[22] Filed: Mar. 28, 1997

[51] Int. Cl.[6] ..... B65B 55/08

[52] U.S. Cl. ..... 53/167; 53/426; 422/24

[58] Field of Search ..... 53/167, 425, 426; 141/85, 89, 92; 422/24; 426/248

[56] References Cited

U.S. PATENT DOCUMENTS

| | | | |
|---|---|---|---|
| 4,175,140 | 11/1979 | Bachman et al. | 53/167 X |
| 4,375,145 | 3/1983 | Mosse et al. | 53/425 |
| 4,877,964 | 10/1989 | Tanaka et al. | 422/24 X |
| 4,910,942 | 3/1990 | Dunn et al. | 53/426 X |
| 5,069,017 | 12/1991 | Fabricius | 53/426 |
| 5,326,542 | 7/1994 | Sizer et al. . | |
| 5,433,920 | 7/1995 | Sizer et al. . | |
| 5,446,289 | 8/1995 | Shodeen et al. | 422/24 X |
| 5,597,597 | 1/1997 | Newman | 422/24 X |
| 5,606,109 | 2/1997 | Hiller et al. | 422/24 X |
| 5,658,530 | 8/1997 | Dunn | 53/426 X |

*Primary Examiner*—Daniel Moon
*Attorney, Agent, or Firm*—Michael A. Catania

[57] ABSTRACT

A packaging machine having a plurality of processing stations is used to form, fill, and seal a carton having interior surfaces and exterior surfaces. The packaging machine includes a sterilization station. The sterilization station comprises a conveyor for transporting the carton through various ones of the processing stations along a processing path, a source of ultraviolet emissions, and an irradiation chamber. The irradiation chamber comprises a plurality of reflecting surfaces substantially surrounding the carton as it passes therethrough along the processing path. The plurality of reflecting surfaces direct ultraviolet light from the source of ultraviolet emissions to irradiate and thereby sanitize the interior surfaces and the exterior surfaces of the container. Preferably, the irradiation chamber comprises an upper parabolic reflecting surface disposed to direct ultraviolet light from the source of ultraviolet emissions downward, a pair of side reflecting surfaces disposed on opposite sides of the conveyor to direct ultraviolet light from the source of ultraviolet emissions toward exterior sides of the cartion, and a lower parabolic reflector disposed to direct ultraviolet light from the ultraviolet source upward.

3 Claims, 2 Drawing Sheets

FILLING MACHINE HAVING A SYSTEM TO AID IN CLEANING EXTERIOR SURFACES OF CARTONS FILLED THEREBY

CROSS-REFERENCE TO RELATED APPLICATIONS

Not applicable

STATEMENT REGARDING FEDERALLY SPONSORED RESEARCH OR DEVELOPMENT

Not applicable

BACKGROUND OF THE INVENTION

The present invention relates to packaging machines for filling containers, and more particularly, to an ultraviolet (UV) reflector system to aid in cleaning exterior surfaces of cartons filled using the machine.

Current packaging machines integrate various components necessary to fill and seal a container into a single machine unit. Such a packaging machine is used to perform a packaging process, which generally stated, includes feeding carton blanks into the machine to form cartons, sealing the bottom of the cartons, filling the cartons with the desired contents, sealing the tops of the cartons, and then off-loading the filled cartons for shipping.

Trends within the field of packaging machines point toward increasingly high capacity machines capable of rapid, continuous filling and sealing of a very large number of identical or similar packaging containers, e.g., containers of the type intended for liquid contents such as milk, juice, and the like. One such machine is disclosed in U.S. Pat. No. 5,488,812, issued Feb. 6, 1996, and entitled "Packaging Machine." The machine disclosed in that patent includes a plurality of processing stations, each station implementing one or more processes to form, fill, and seal the containers. Each of the processing stations is driven by one or more servomotors that drive the various components of each of the processing stations.

Another type of packaging machine is exemplified by the TR/7™ and TR/8™ packaging machines manufactured and available from Tetra Pak, Inc. Such machines are of a more conventional type in which many of the components are driven from a common drive motor through, for example, indexing gears and cam mechanisms.

Certain filling machines are designed to provide sterile filling operations. For example, perishable food products, i.e., milk, juices, etc., are packaged using filling machines incorporating sterilizing stations. Typically, the inside of a carton is sterilized. The cartons may be sterilized using hydrogen peroxide, UV light or heat. An example of an apparatus for use in a packaging machine that sterilizes carton interiors using UV light is disclosed in U.S. Pat. No. 5,326,542 owned by the assignee of this application and incorporated herein by reference. The device disclosed therein includes an ultraviolet sterilizing system for food cartons. An elongated UV lamp is arranged in a housing. A corresponding parabolic reflector is mounted in the housing to direct sterilizing UV light down into the interior of cartons as they are presented below the lamp via a conveyor.

The presently known product filling machines provide sterilization of the interior of cartons. However, the present inventors have recognized that exteriors of the cartons are also likely to be "dirty" and can cause contamination during the sterile filling processes. Thus, the inventors have developed an apparatus to effectively clean the exterior of the cartons processed in a filling machine.

BRIEF SUMMARY OF THE INVENTION

A packaging machine having a plurality of processing stations is used to form, fill, and seal a carton having interior surfaces and exterior surfaces. The packaging machine includes a sterilization station. The sterilization station comprises a conveyor for transporting the carton through various ones of the processing stations along a processing path, a source of ultraviolet emissions, and an irradiation chamber. The irradiation chamber comprises a plurality of reflecting surfaces substantially surrounding the carton as it passes therethrough along the processing path. The plurality of reflecting surfaces direct ultraviolet light from the source of ultraviolet emissions to irradiate and thereby sanitize the interior surfaces and the exterior surfaces of the container. Preferably, the irradiation chamber comprises an upper parabolic reflecting surface disposed to direct ultraviolet light from the source of ultraviolet emissions downward, a pair of side reflecting surfaces disposed on opposite sides of the conveyor to direct ultraviolet light from the source of ultraviolet emissions toward exterior sides of the cartion, and a lower parabolic reflector disposed to direct ultraviolet light from the ultraviolet source upward.

An advantage of an embodiment of the system is that it effectively reflects the UV light onto the bottom and sides of the exterior of the carton to provide a disinfecting effect on the outer surfaces of the carton which are prone to contamination.

Another advantage of an embodiment of the UV light reflector system is that it effectively reflects the UV light onto the bottom and sides of the exterior of the carton by using the same UV sterilizing station that is used to sterilize the interior of the carton.

A further advantage of an embodiment of the UV light reflector system is that it helps to sterilize the exterior surface of the carton by illumination with UV light without disrupting ordinary filling machine operation.

DETAILED DESCRIPTION OF THE INVENTION

Figure 1:
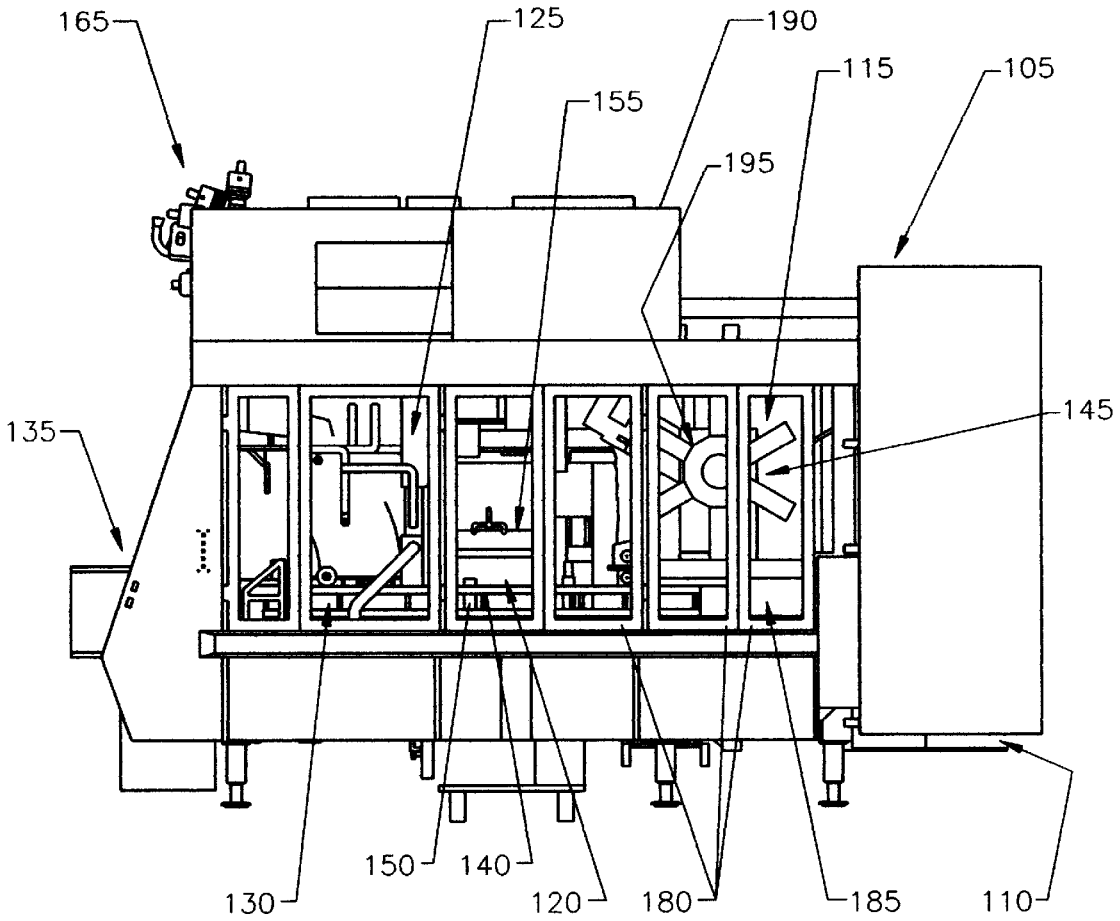
FIG. 1 is a side view of an embodiment of a filling machine illustrating the relative orientation of an embodiment of the UV reflector system.

FIG. 1 illustrates an embodiment of a filling machine that may incorporate the present invention. As illustrated, the filling machine, shown generally at 100, comprises a plurality of processing stations. In the illustrated embodiment, the stations are arranged sequentially within the filling machine 100 as follows: a carton magazine station 110, a carton forming station 115, a sterilizing station 120, a carton filling station 125, a carton sealing station 130 and a carton off-loading station 135. The cartons, gable-top cartons in the illustrated example, are transported between the carton forming station 115, sterilizing station 120, carton filling station 125, carton sealing station 130, and carton off-loading station 135 by a conveyor system 140. The processing stations are, for example, under the control of a control unit that is disposed in a control cabinet 105. The control unit monitors and controls the operation of the filling machine 100.

In operation of the machine 100, a supply of carton blanks are arranged at the carton magazine station 110. Individual carton blanks are erected and subsequently removed from the carton magazine station 110 and placed on a mandrel 145 located in the carton forming station 115. While on the mandrel 145, the erected cartons are rotated between subsequent bottom-sealing stations to form a carton 150 having an open top and a sealed bottom. The carton 15 is then removed from the mandrel 145 and transferred to the conveyor 140.

The carton is subsequently transported to the sterilizing station 120 while having its top in an open condition. At the sterilizing station 120, the cartons are subject to a hydrogen peroxide spray followed by UV irradiation by an ultraviolet light assembly 155 to sterilize both the interior and exterior of the carton prior to filling with product. The mechanism utilized for such interior and exterior sterilization will be described in greater detail below.

Each carton 150 having a sterilized interior and exterior is transferred from the sterilizing station 120 to the carton filling station 125 where it is filled with product. The product is provided to each carton through a pump and a fill pipe which are connected to receive product from a balance or intermediate storage tank 160 through a valve cluster 165. One example of such a valve cluster 165 is described in a patent application entitled "Interface Group for Aseptic and Non-aseptic Machines," U.S. Ser. No. 08/810,613, filed Feb. 28, 1997 now U.S. Pat. No. 5,755,155.

Preferably, the filling station 125 is substantially isolated from other portions of the machine to thereby maintain the atmosphere in the filling station in a very hygienic condition. To this end, the filling station may be provided with walls that define a filling chamber into which a flow of sterile air is provided. The walls would have narrow openings through which the cartons enter the filling station. Such a filling station is described in U.S. Ser. No. 08/828,329 and in U.S. Ser. No. 08/828,931 both of which are filed on even date herewith and incorporated by reference.

Once filled with product, each carton 150 is closed and sealed at the carton sealing station 130. The carton sealing station 130 comprises a top folder mechanism that, for example, uses a pair of opposed wheels to temporarily fold and seal the top of the carton. The top sealing station 130 further comprises a top sealer, such as an ultrasonic sealer, that hermetically seals the top of the carton. An example of such a carton sealing station 130 is disclosed in a patent application entitled, "Top Folding and Sealing Apparatus For Forming and Sealing the Fin of a Gabled Carton, " U.S. Ser. No. 08/828,311, filed on even date herewith. Other top sealing mechanisms are likewise suitable for use in the illustrated machine. After the carton is filled and sealed, it is transferred out of the filling machine 100 at the off-loading station 135.

Figure 2:
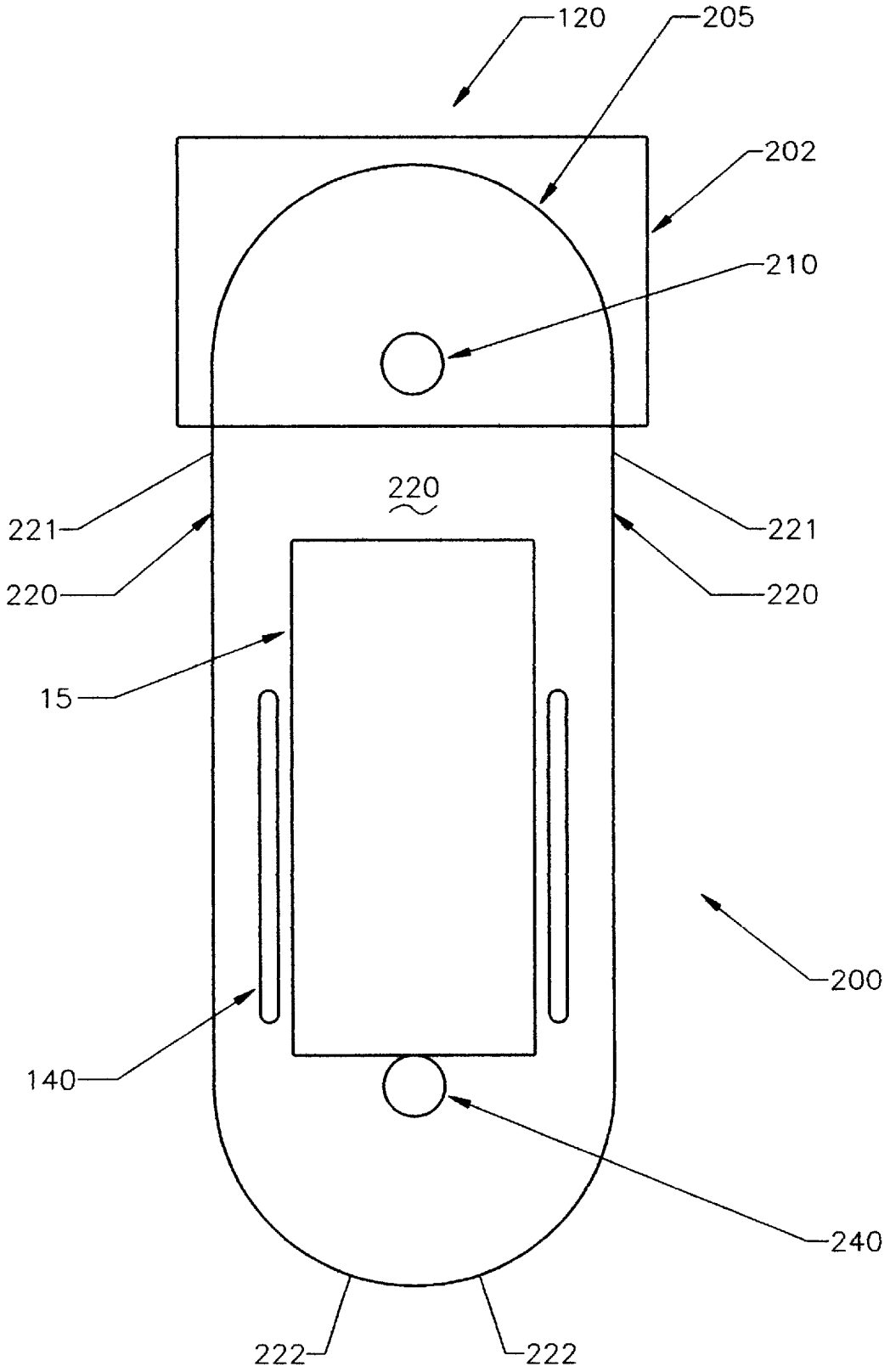
FIG. 2 is a diagrammatic view of a portion of the filling machine of FIG. 1 illustrating the sterilizing station and an embodiment of the UV reflector system.

FIG. 2 is a side diagrammatic view of a portion of the sterilization station 120 of the filling machine of FIG. 1. As shown, the sterilization station 120 comprises an ultraviolet lamp assembly 202, such as the one disclosed in the foregoing '542 patent. The ultraviolet lamp assembly 202, generally stated, comprises an ultraviolet lamp 210 and a corresponding reflector hood 205 that is designed to direct UV emissions from the lamp 210 downward. Side reflectors 220 are disposed on opposite sides of the conveyor 140. Each of the side reflectors 220 comprises an upper end 221 disposed proximate the lamp assembly 202 and a lower end 222 which curves in a parabolic fashion and joins, or extends proximate to the other of the side reflectors. The lamp assembly 202 and the side reflectors 220 effectively define an irradiation chamber 225 through which each carton 15 is conveyed by the conveyor 140 prior to entering the fill chamber of the filling station 125. As each carton 15 is conveyed therethrough, it has its interior portions and exterior portions irradiated with UV light to thereby sanitize the container prior to filling. Such sanitization further reduces the likelihood that the fill chamber will be contaminated, thereby enhancing the sterility of the filling process.

Advantageously, the sterilization station 120 may also comprise a reflective rail 240 that supports the carton 15 as it passes through the irradiation chamber 225. Such a reflective rail further enhances the amount of ultraviolet light impinging on the exterior surfaces of the carton 15.

As a further enhancement to the ultraviolet light assembly 202, it may be constructed to lift and pivot, either manually or automatically, so as to enhance servicability and cleaning. Such a construction is shown and described in U.S. Ser. No. 08/828,927, filed on even date herewith and incorporated by reference.

While particular elements, embodiments and applications of the present invention have been shown and described, it will be understood, of course, that the invention is not limited thereto since modifications may be made by those skilled in the art, particularly in light of the foregoing teachings. It is therefore contemplated by the appended claims to cover such modifications as incorporate those features which come within the spirit and scope of the invention.

I claim:

1. A sterilization station in a form, fill and seal packaging machine for processing a series of cartons being transported on a conveyor along a linear carton path, each of the cartons having an open top end, a sealed bottom end and a plurality of sidewalls extending from the bottom end to the open top end which define the exterior of each of the cartons, the sterilization station preceding a filling station, the sterilization station comprising:

a hydrogen peroxide sprayer for spraying hydrogen peroxide in the interior of each of the cartons and on the exterior of each of the cartons as each cartons enters the sterilization station;

an irradiation chamber disposed downline from the hydrogen peroxide sprayer, the irradiation chamber encompassing a section of the carton path and having an ingress end for each carton to enter the irradiation chamber and an egress end for each carton to exit the irradiation chamber, the irradiation chamber comprising an ultraviolet lamp disposed above the carton path to irradiate the interior and exterior of each of the cartons with ultraviolet energy as each carton enters the irradiation chamber, an upper reflector having a parabolic surface towards the ultraviolet lamp, the upper reflector disposed above the ultraviolet lamp, a lower reflector having a parabolic surface towards the upper reflector, the lower reflector disposed below the carton path, a first substantially flat side reflector disposed to one side of the carton path and connected to the lower and upper reflectors, a second substantially flat side reflector disposed to the other side of the carton path, opposite the first side reflector, and connected to the lower and upper reflectors;

whereby the direct and reflective irradiation of the interior and exterior of each of the cartons coated with hydrogen peroxide effectively sterilizes each of the cartons for filling at a subsequent station on the packaging machine.

2. The sterilization apparatus of claim 1 further comprising a reflective rail on which each of the cartons is transported through the irradiation chamber.

3. A form, fill and seal packaging machine for processing a series of cartons, the carton transported on a conveyor along a linear carton path, each of the cartons having an open top end, a sealed bottom end and a plurality of sidewalls extending from the bottom end to the open top end which define the exterior of each of the cartons, the packaging machine comprising:

a hydrogen peroxide sprayer for spraying hydrogen peroxide in the interior of each of the cartons and on the exterior of each of the cartons as each cartons enters a sterilization station;

an irradiation chamber disposed downline from the hydrogen peroxide sprayer, the irradiation chamber encompassing a section of the carton path and having an ingress end for each carton to enter the irradiation chamber and an egress end for each carton to exit the irradiation chamber, the irradiation chamber comprising an ultraviolet lamp disposed above the carton path to irradiate the interior and exterior of each of the cartons with ultraviolet energy as each carton enters the irradiation chamber, an upper reflector having a parabolic surface towards the ultraviolet lamp, the upper reflector disposed above the ultraviolet lamp, a lower reflector having a parabolic surface towards the upper reflector, the lower reflector disposed below the carton path, a first substantially flat side reflector disposed to one side of the carton path and connected to the lower and upper reflectors, a second substantially flat side reflector disposed to the other side of the carton path, opposite the first side reflector, and connected to the lower and upper reflectors; and a substantially isolated fill chamber disposed immediately subsequent to the irradiation chamber, the fill chamber having a flow of sterile air therethrough, the fill chamber receiving newly sterilized cartons from the irradiation chamber through narrow openings in a wall of the fill chamber, and filling each of the cartons with a product.

* * * * *